US008191293B2

(12) United States Patent
Trotman

(10) Patent No.: US 8,191,293 B2
(45) Date of Patent: Jun. 5, 2012

(54) DIGITAL DISPLAY ADVERTISING APPARATUS FIXABLE TO A PRINTED DIRECTORY

(75) Inventor: Douglas Keith Trotman, Dallas, TX (US)

(73) Assignee: AT&T Intellectual Property I, L.P., Reno, NV (US)

( * ) Notice: Subject to any disclaimer, the term of this patent is extended or adjusted under 35 U.S.C. 154(b) by 248 days.

(21) Appl. No.: 12/565,684

(22) Filed: Sep. 23, 2009

(65) Prior Publication Data

US 2011/0067277 A1 Mar. 24, 2011

(51) Int. Cl.
*G09F 9/37* (2006.01)

(52) U.S. Cl. ..... 40/446; 40/124.03; 40/124.04; 281/15.1

(58) Field of Classification Search ..... 40/446, 40/447, 124.02, 124.03, 124.04; 283/64; 281/15.1
See application file for complete search history.

(56) References Cited

U.S. PATENT DOCUMENTS

| | | | | | |
|---|---|---|---|---|---|
| D384,942 | S | * | 10/1997 | Vinuela | D14/346 |
| 5,748,906 | A | * | 5/1998 | Sandig | 705/1.1 |
| 5,997,475 | A | * | 12/1999 | Bortz | 600/300 |
| D428,412 | S | * | 7/2000 | Davis | D14/341 |
| 2003/0104833 | A1 | * | 6/2003 | Chiu | 455/556 |
| 2006/0006637 | A1 | * | 1/2006 | DeAngelis | 281/15.1 |
| 2006/0253578 | A1 | * | 11/2006 | Dixon et al. | 709/225 |
| 2008/0204470 | A1 | * | 8/2008 | Kato | 345/593 |
| 2008/0316186 | A1 | * | 12/2008 | O'Brien | 345/173 |

* cited by examiner

*Primary Examiner* — Gary Hoge
(74) *Attorney, Agent, or Firm* — Greenberg Traruig, LLP

(57) ABSTRACT

A solar powered advertising apparatus comprising a digital display to display an advertisement heading, wherein the apparatus is configured to be affixable to an exterior of a printed directory. The apparatus comprises a memory to store a set of advertisement headings, with the advertisement headings stored in the memory prior to affixing the advertising apparatus to the printed directory. The advertising apparatus further comprises a set of buttons for selecting an advertisement heading to be displayed.

20 Claims, 3 Drawing Sheets

DIGITAL DISPLAY ADVERTISING APPARATUS FIXABLE TO A PRINTED DIRECTORY

FIELD OF THE TECHNOLOGY

At least some embodiments of the disclosure relate to a digital display advertising apparatus fixable to a printed directory.

BACKGROUND

Traditional printed directories for residential telephone listings (e.g., White Pages) and for commercial telephone listings (e.g., Yellow Pages) remain a popular resource among consumers. Considering the popularity of using the printed directories, there is a valuable opportunity to sell the space on the exterior cover of the printed directories for placement of advertisements. However, the space available on the cover and the spine of the printed directories is limited. As a result, the cost of placing advertisements on the exterior cover of the printed directories is relatively high.

SUMMARY

One embodiment described herein presents a solar powered advertising apparatus comprising a digital display to display an advertisement heading, wherein the apparatus is configured to be affixable to an exterior of a printed directory. The apparatus comprises a memory to store a set of advertisement headings, with the advertisement headings stored in the memory prior to affixing the advertising apparatus to the printed directory. The advertising apparatus further comprises a set of buttons for selecting an advertisement heading to be displayed.

Other features will be apparent from the accompanying drawings and from the detailed description which follows.

BRIEF DESCRIPTION OF THE DRAWINGS

The embodiments are illustrated by way of example and not limitation in the figures of the accompanying drawings in which like references indicate similar elements.

DETAILED DESCRIPTION

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
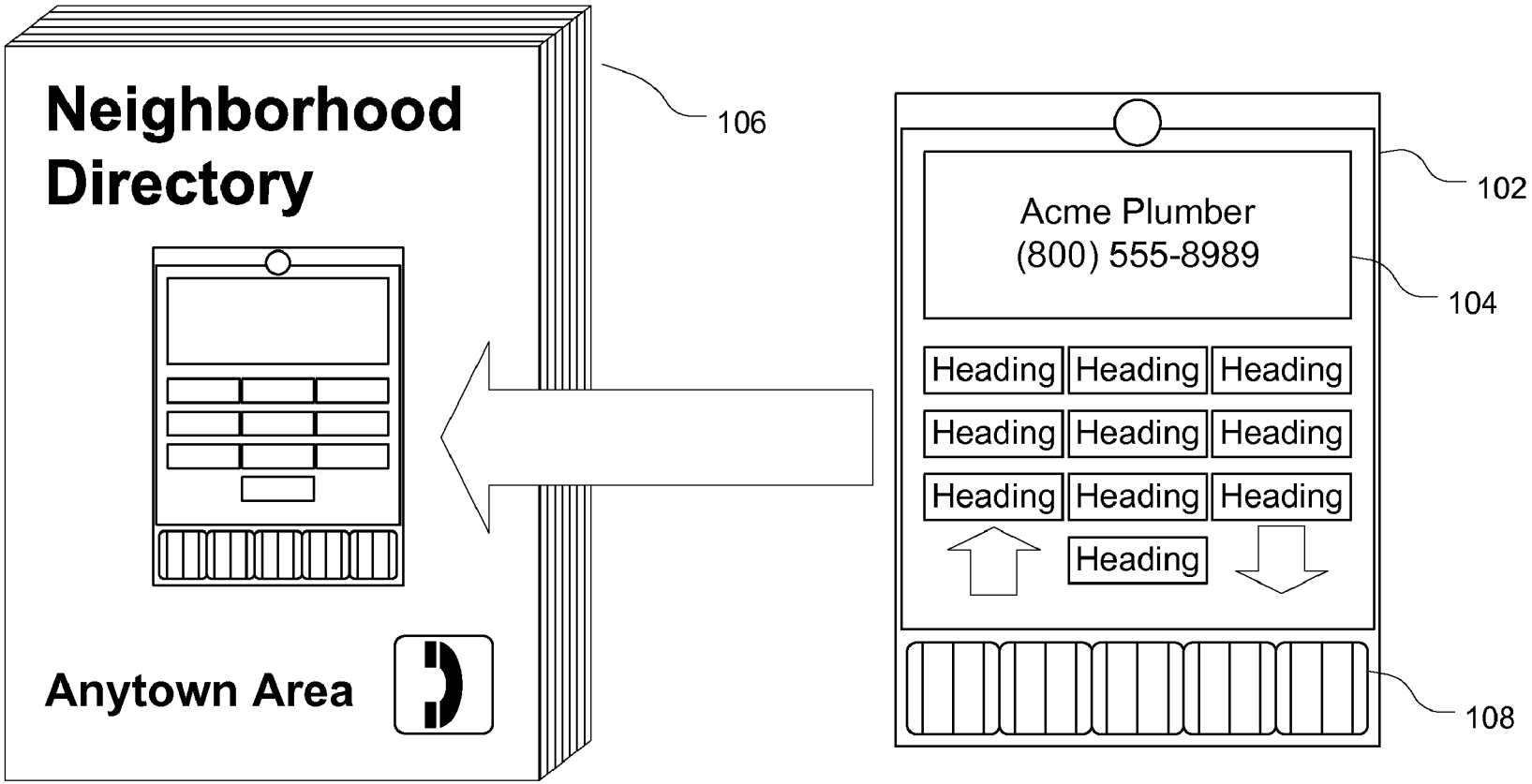
FIG. 1 illustrates an digital display advertising apparatus affixable to a printed directory, according to one embodiment.

As illustrated in FIG. 1, one embodiment provides a low-cost advertising platform in the form of an advertising apparatus 102 to be affixed to a front cover or spine of a print directory 106 (e.g., White Pages or Yellow Pages). In one embodiment the advertising apparatus 102 comprises of a digital display 104 to display advertisement headings. In one embodiment the display is monochrome. In alternative embodiment, the display may be a color display. In one embodiment, the digital display displays the advertisement headings in the form of a hologram.

The advertisement headings to be displayed are pre-stored a memory of the advertising apparatus before the advertising apparatus is affixed to the printed directory. In one embodiment, the memory comprises of 1 MB or less. In alternative embodiments the memory of the advertising apparatus comprises of a memory unit having any size selected from one of, equal to or less than 1 MB of space of memory, greater than 1 MB of space and equal to or less than 2 MB of space of memory, or greater than 2 MB of space and equal to or less than 4 MB of space. In alternative embodiments, the memory unit may comprise of a different size of memory without departing from the invention.

In one embodiment, the advertising apparatus includes a set of buttons for selecting advertisement headings (e.g. "restaurants"), and move between listings. In one embodiment, when not in use, a pre-selected advertisement heading (e.g., a national advertiser) is displayed on the advertising apparatus. In an alternative embodiment, advertisements are imprinted on the advertising apparatus.

In one embodiment, the advertising apparatus comprises dimensions of 3 inches in width by 5 inches in length by ¼ inch in height. In alternative embodiments the dimensions of the advertising apparatus could vary without departing from the invention. In one embodiment the weight of the advertising apparatus does not exceed 4 ounces.

In one embodiment, the advertising apparatus is powered by a solar powered unit 108. In alternative embodiments, the advertising apparatus could be powered by a thin film battery powered unit.

In one embodiment, the advertising apparatus includes a magnetic strip 120 (shown in FIG. 3) affixed to the apparatus to have the advertising apparatus be fixable to a metallic surface once removed from the printed directory.

In one embodiment, the advertising apparatus further comprises functionality to display a clock and/or a calculator. In one embodiment the advertising apparatus comprises functionality to display and operate electronic games. In one embodiment, the advertising apparatus displays coupons. In one embodiment the advertising apparatus displays other local information.

Figure 2:
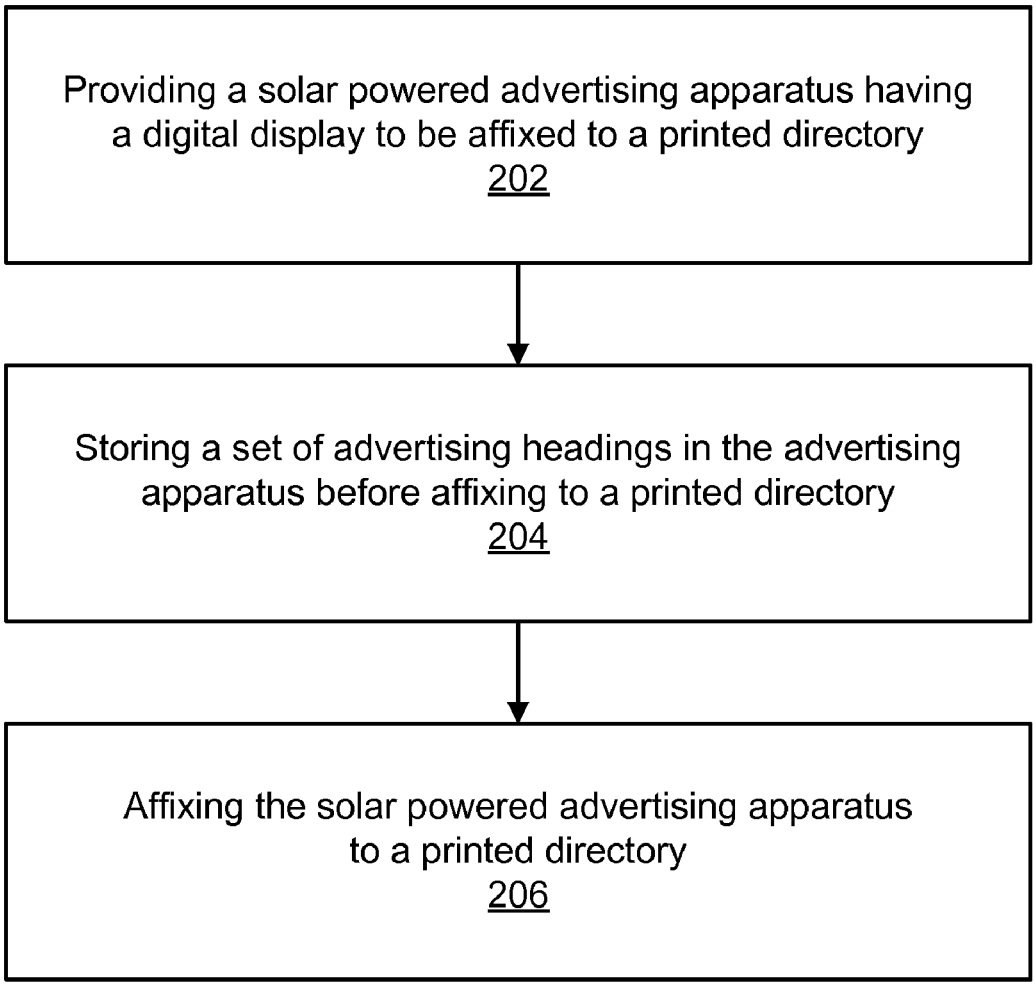
FIG. 2 illustrates a flow diagram describing a method of providing digital display advertising apparatus affixable to a printed directory, according to one embodiment.

FIG. 2 illustrates a flow diagram describing a method of providing an advertising apparatus fixable to a printed directory, in accordance with one embodiment. Providing, in process 202, a solar powered advertising apparatus comprising a digital display to display an advertisement heading, wherein the advertising apparatus is configured to be affixed to an exterior of a printed directory.

Storing, in process 204, a set of advertisement headings in a memory of the advertising apparatus, prior to the apparatus being affixed to a printed directory. Affixing the advertising apparatus to an exterior of a printed directory, in process 206, wherein the advertising apparatus is to be powered by solar generated energy, and the advertising apparatus comprises a set of buttons for selecting an advertisement heading to be displayed.

Figure 3:
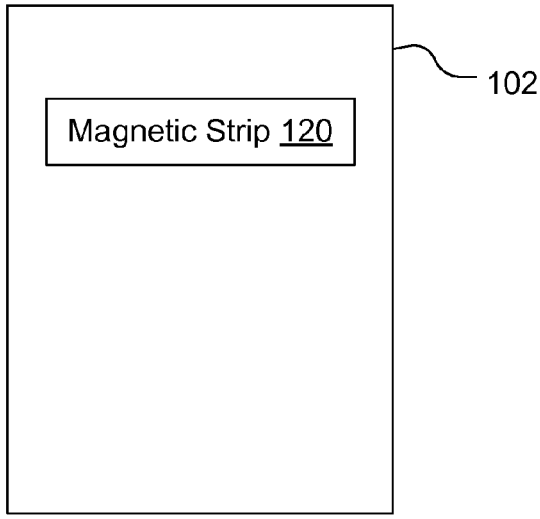
FIG. 3 shows a back view of the apparatus of FIG. 1.
Figure 4:
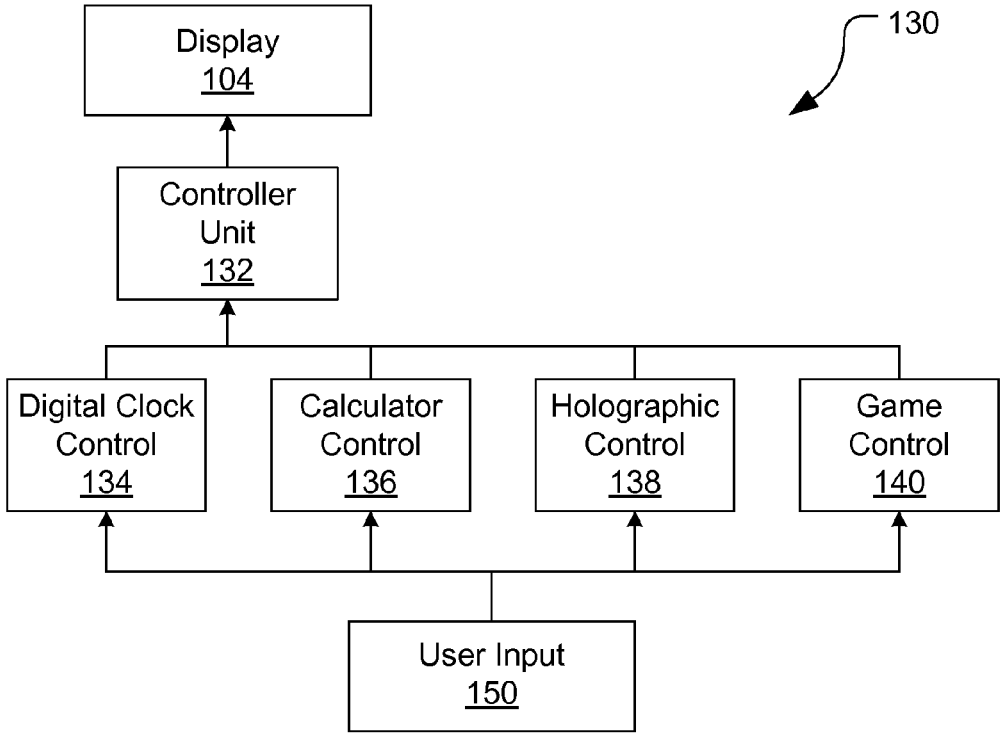
FIG. 4 shows a schematic block diagram view of a controller for the apparatus of FIG. 1.

Turning now to FIG. 3 there is shown a back view of the apparatus 102 of FIG. 1. The back has a magnetic strip 120 attached to the back for use in attaching the apparatus 102 to a metallic object. FIG. 4 illustrates in schematic and block diagram form a controller 130 for the apparatus 102, which may be housed internally of the housing of the apparatus 102. The controller 130 can have a controller unit 132, such as a microprocessor or other suitable computing device. The controller unit can be connected to and control the display 104. The controller can receive instructions or data or both from a digital clock control module 134, a calculator control module 136, a holographic display control module 138 and an electronic game control module 140. The control modules 134, 136, 138 and 140 may receive input from a user input 150.

In this description, various functions and operations may be performed by or caused by the execution of software code that produces the result from execution of the code/instructions by a processor, such as a microprocessor. Alternatively, or in combination, the functions and operations can be implemented using special purpose circuitry, with or without software instructions, such as using Application-Specific Integrated Circuit (ASIC) or Field-Programmable Gate Array (FPGA). Embodiments can be implemented using hardwired circuitry without software instructions, or in combination with software instructions. Thus, the techniques are limited neither to any specific combination of hardware circuitry and software, nor to any particular source for the instructions executed by the data processing system.

At least some aspects disclosed can be embodied, at least in part, in software. That is, the techniques may be carried out in a computer system or other data processing systems in response to its processor, such as a microprocessor, executing sequences of instructions contained in a memory, such as ROM, volatile RAM, non-volatile memory, cache or a remote storage device.

Routines executed to implement the embodiments may be implemented as part of an operating system or a specific application, component, program, object, module or sequence of instructions referred to as "computer programs." The computer programs typically include one or more instructions set at various times in various memory and storage devices in a computer, and that, when read and executed by one or more processors in a computer, cause the computer to perform operations necessary to execute elements involving the various aspects.

A machine readable medium can be used to store software and data, which when executed by a data processing system, causes the system to perform various methods. The executable software and data may be stored in various places including, for example, ROM, volatile RAM, non-volatile memory and/or cache. Portions of this software and/or data may be stored in any one of these storage devices.

Examples of computer-readable media include, but are not limited to, recordable and non-recordable type media such as volatile and non-volatile memory devices, read only memory (ROM), random access memory (RAM), and flash memory devices. The computer-readable media may store the instructions.

In various embodiments, hardwired circuitry may be used in combination with software instructions to implement the techniques. Thus, the techniques are neither limited to any specific combination of hardware circuitry and software nor to any particular source for the instructions executed by the data processing system.

Although some of the drawings illustrate a number of operations in a particular order, operations that are not order-dependent may be reordered and other operations may be combined or broken out. While some reordering or other groupings are specifically mentioned, others will be apparent to those of ordinary skill in the art and so do not present an exhaustive list of alternatives. Moreover, it should be recognized that the stages could be implemented in hardware, firmware, software or any combination thereof.

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

What is claimed is:

1. An apparatus comprising:

a digital display configured to display an advertisement heading;

a memory configured to store a set of advertisement headings; and a set of buttons configured to select advertisement heading being displayed;

wherein the apparatus is affixed to an exterior of a printed directory, the apparatus being powered by solar generated energy.

2. The apparatus of claim 1, further comprising a magnetic strip configured to affix the apparatus to a metallic surface after being removed from the printed directory.

3. The apparatus of claim 1, wherein the apparatus is affixed to one of a front cover and a spine of the printed directory.

4. The apparatus of claim 1, wherein at least one advertisement heading is displayed as a hologram.

5. The apparatus of claim 1, wherein a height of the apparatus is less than a quarter of an inch.

6. The apparatus of claim 1, wherein the display comprises a monochrome display.

7. The apparatus of claim 1, wherein the memory is less than 1 megabyte.

8. The apparatus of claim 1, wherein the memory is greater than 1 megabyte and less than 2 megabytes.

9. The apparatus of claim 1, wherein the memory is greater than 2 megabytes and less than 4 megabytes.

10. The apparatus of claim 1, further comprising a digital clock display.

11. The apparatus of claim 1, further comprising a calculator and calculator display.

12. The apparatus of 11, further configured to provide access to and display of electronic games.

13. A method comprising:

providing a solar powered advertising apparatus comprising a digital display displaying an advertisement heading, wherein the advertising apparatus is configured to be affixable to an exterior of a printed directory, and the advertising apparatus comprises a set of buttons for selecting an advertisement heading to be displayed;

storing a set of advertisement headings in a memory of the advertising apparatus, prior to affixing the advertising apparatus to the printed directory; and affixing the advertising apparatus to the exterior of the printed directory.

14. The method of claim 13, wherein the advertising apparatus further comprises a magnetic strip for affixing the advertising apparatus to a metallic surface after removal from the printed directory.

15. The method of claim 13, wherein affixing the advertising apparatus to the exterior of the printed directory comprises affixing the advertising apparatus to one of a front cover and a spine of the printed directory.

16. The method of claim 13, wherein at least one advertisement heading is displayed as a hologram.

17. The method of claim 13, wherein a height of the advertising apparatus is less than a quarter of an inch.

18. The method of claim 13, wherein the display comprises a monochrome display.

19. The method of claim 13, wherein the advertising apparatus displays at least one of a digital clock and a calculator.

20. An apparatus comprising:

a digital display configured to display an advertisement heading;

a memory configured to store a set of advertisement headings; and a set of buttons configured to select advertisement heading being displayed;

wherein the apparatus is affixed to an exterior of a printed directory.

* * * * *